US006691628B2

(12) United States Patent
Meyer et al.

(10) Patent No.: US 6,691,628 B2
(45) Date of Patent: Feb. 17, 2004

(54) METHOD AND APPARATUS FOR THERMAL PROCESSING OF POWDER RAW MATERIALS

(75) Inventors: Hans-Wilhelm Meyer, Langenzenn (DE); Michael Siegert, Rösrath (DE)

(73) Assignee: KHD Humboldt Wedag AG, Cologne (DE)

( * ) Notice: Subject to any disclaimer, the term of this patent is extended or adjusted under 35 U.S.C. 154(b) by 0 days.

(21) Appl. No.: 10/234,760

(22) Filed: Sep. 4, 2002

(65) Prior Publication Data

US 2003/0056935 A1 Mar. 27, 2003

(30) Foreign Application Priority Data

Sep. 20, 2001 (DE) ..... 101 46 418

(51) Int. Cl.[7] ..... F23J 15/00; F23G 7/06; F23K 1/00

(52) U.S. Cl. ..... 110/345; 110/210; 110/212; 110/214; 110/218; 110/246; 432/14; 432/106

(58) Field of Search ..... 110/210, 211, 110/212, 213, 214, 218, 246, 342, 344, 345; 432/14, 106, 103; 106/745, 750, 752, 758, 761, 771

(56) References Cited

U.S. PATENT DOCUMENTS 3,904,353 A * 9/1975 Bosshard et al. ..... 432/14
4,071,309 A * 1/1978 Yamane ..... 432/14
4,110,121 A * 8/1978 Rechmeier et al. ..... 106/100
4,303,477 A * 12/1981 Schmidt et al. ..... 201/2.5
4,361,100 A * 11/1982 Hinger ..... 110/238
4,416,697 A * 11/1983 Zagar et al. ..... 106/100
4,431,454 A * 2/1984 Krennbauer ..... 106/100
4,640,681 A * 2/1987 Steinbiss et al. ..... 432/14
4,913,742 A * 4/1990 Kwech ..... 106/100
4,960,577 A * 10/1990 Torbov et al. ..... 423/242
5,349,910 A * 9/1994 Hundebol ..... 110/346
5,365,866 A * 11/1994 Von Seebach et al. ..... 110/345
5,782,188 A * 7/1998 Evans et al. ..... 110/346
5,800,610 A * 9/1998 Jons ..... 106/743
6,213,764 B1 * 4/2001 Evans ..... 432/106

FOREIGN PATENT DOCUMENTS

DE 0497937 B1 * 8/1992 ..... F27B/7/20

* cited by examiner

*Primary Examiner*—K. B. Rinehart
(74) *Attorney, Agent, or Firm*—Sonnenschein Nath & Rosenthal LLP

(57) ABSTRACT

In the manufacture of cement clinker from cement raw meal, sulfide-containing raw materials or raw materials with a high TOC (total organic carbon) level can be used for cement manufacture, which are uncontrollably incompletely burned in the upper cyclone of a heat exchange line, thus leading to high emissions of CO, VOC (volatile organic carbon), and $S^{2-}$ in the waste gas. To reduce or completely eliminate such elevated emissions, an oxidation zone is provided in an waste gas duct downstream of the heat exchange line in the gas flow path, having an afterburner, the waste gas being caused positively to pass through open flames of the afterburner to assure the economical oxidation of the waste gas.

18 Claims, 2 Drawing Sheets

METHOD AND APPARATUS FOR THERMAL PROCESSING OF POWDER RAW MATERIALS

BACKGROUND OF THE INVENTION

The invention relates to a method and apparatus for thermal processing of powder raw materials, more specifically, in the manufacture of cement clinker from cement raw meal, which is preheated in at least one heat exchange line, more specifically a cyclone heat exchange system through which a rotary kiln waste gas flows, calcined in a pre-calcination stage, and fired in the sintering zone of the rotary kiln into cement clinker, which is cooled in a downstream cooler, the rotary kiln waste gas flow supplied with fuel in the pre-calcination stage being used for the pre-calcination of the raw meal, and the waste gas flow of the heat exchange line is optionally fed to waste gas conditioning through a scrubber.

To avoid using an uneconomical long or large-diameter rotary kiln for the manufacture of cement clinker from raw meal and also to minimize the specific energy consumption of the cement clinker manufacturing process, it is known to provide a pre-calcination stage of a rotary kiln. As described, e.g., in EP-B 0 497 937, such a pre-calcination stage is provided between the heat exchange line and the rotary kiln and has at least one additional furnace (in addition to the rotary kiln furnace). Fuel is added in the pre-calcination stage to the rotary kiln waste gas that is contained in the cement raw meal preheated in the heat exchange line, whereby highly calcined cement raw meal is obtained through fuel combustion to be fed to the rotary kiln.

Taking into account emissions of pollutants such as, for example, CO and $NO_x$, it is known to burn fuel in the pre-calcination stage in a quantity below the stoichiometric quantity by providing a CO-containing reducing zone for reducing harmful $NO_x$, which are formed especially in high-temperature fired rotary kilns (thermal $NO_x$). CO that is not consumed in the $NO_x$ reduction zone of rotary kiln waste gas ducts and also in the pre-calcination stage, more specifically at the non-burned fuel particles, is after-burned with oxygen of a tertiary air flow supplied from the clinker cooler. This residual burning is facilitated by diverting a flow of a gas-solid suspension in the pre-calcination stage, more specifically, by providing a swirl chamber or mixing chamber in the flow diverting area.

The above-described measures are used to reduce the undesired pollutant emissions that are formed from reaction products and from non-burned fuel components, the harmful emissions occurring directly in the rotary kiln or in the pre-calcination stage that is provided immediately upstream the rotary kiln. Since lower temperatures often cannot be achieved in the further treatment of the waste gas, or they cannot be achieved except at a high cost (e.g., by using activated charcoal filtering), the above-described measures require that the waste gas be treated as close as possible to the point where the pollutants are formed before the waste gas enters the heat exchange line.

However, such treatment in certain cases is not possible, and the pollutants remain in the raw materials. This is the case, e.g., when raw materials that are used for cement clinker manufacture have a high sulfide level or an elevated TOC (total organic carbon) level, e.g., when the raw material contains bituminous shale, and the raw materials are uncontrollably incompletely burned in the upstream cyclone stage, thus resulting in higher emissions of CO, VOC (volatile organic carbon), and $S^{2-}$ in the waste gas.

SUMMARY OF THE INVENTION

To obviate the difficulties encountered in burning such raw materials, according to the invention, it is an object of the invention to provide an economical and efficient method and an apparatus for carrying out same which would allow for using the energy of a raw material having high content of TOC and/or sulfides for cement clinker manufacture without substantial technical and structural problems.

The above object is accomplished according to the invention as far as the method is concerned by directing the entire waste gas flow through an oxidation zone having an excess of oxygen and open flames provided by an afterburner. The features recited in the method regarding the apparatus embodying the principles of the present invention, an oxidation zone with an afterburner is provided in the waste gas duct between an uppermost cyclone stage of the heat exchange line and the scrubber and/or a dust filter. The entire flow of the waste gas that moves through the waste gas duct being directed through open flames of the afterburner.

In a method according to the invention, it is provided that, for complete burnout or oxidation of substances of the waste gas in the heat exchange line, which have high level of CO, $S^{2-}$, VOC (volatile organic carbon), e.g., hydrocarbons because of respectively high level of TOC (total organic carbon) and/or sulfide in the raw materials, which result in high harmful emissions, the entire waste gas flow is directed through an oxidation zone having an excess of oxygen and open flames produced by an afterburner.

The desired oxidation of harmful materials depends only on the thermal reactions, more specifically, on reactions between the harmful substances and the radicals of the open flames. The waste gas temperature after the afterburning is normally within the range from 450° C. to 680° C.

To save energy, the afterburner can use conventional fuels such as natural gas or oil. In a preferred embodiment of the invention, it is also possible to use alternative fuels such as waste oil (e.g., PCB-free).

According to the invention, the afterburner can be installed upstream of a scrubber in the path of the waste gas (with the adsorption of $S^{2-}$, oxidation of VOC and/or CO) and/or downstream of the scrubber for the waste gas that has been pre-cleaned from dust.

For economic burnout with oxidation of the harmful contents of the waste gas, according to another preferred embodiment of the invention, the waste gas is fed into an afterburner duct provided downstream of the afterburner with a residence time there of about 1.5 seconds with swirling, and, to enhance the swirling in the afterburner duct, a swirling chamber is provided, e.g., in the upper turn thereof.

To cool down the waste gas that is heated in the afterburner and to keep constant oxygen excess in the oxidation zone, it is provided according to an embodiment of the invention that fresh air is admitted to an waste gas line immediately downstream of the afterburner. If this cooling is not sufficient, or as an alternative or in addition to this cooling, the temperature of the waste gas that leaves the heat exchange line is lowered before the entry to the afterburning duct, e.g., by providing a cyclone stage as an extension of the heat exchange line. In this case, energy supply from the afterburning can be used in an optimum manner for raw meal drying or for a crusher and drier plant.

Another possibility of cooling the waste gas that has been heated too much in the afterburner resides in matching the scrubber that is installed upstream, more specifically, its cooling capacity, in the event that the oxidation zone incorporates a scrubber.

If the afterburner according to the invention is used in the path of the waste gas flow between the heat exchange line and a dust filter, it is possible to control the temperature of the waste gas that is used for raw meal drying/for the crusher and drier plant in such a manner that this temperature will never exceed the temperature of the heat exchange line and that this temperature will be exactly as per the seasonal requirements for the afterburner. This exact temperature control can be advantageously used to further optimize performance of the crusher and drier plant.

Other advantages, properties, and features of the invention will become apparent from the following description of an illustrated schematic flow diagram of an exemplary embodiment of an apparatus for the manufacture of cement clinker and a schematic representation of an afterburner.

DETAILED DESCRIPTION OF THE PREFERRED EMBODIMENT

Figure 1:
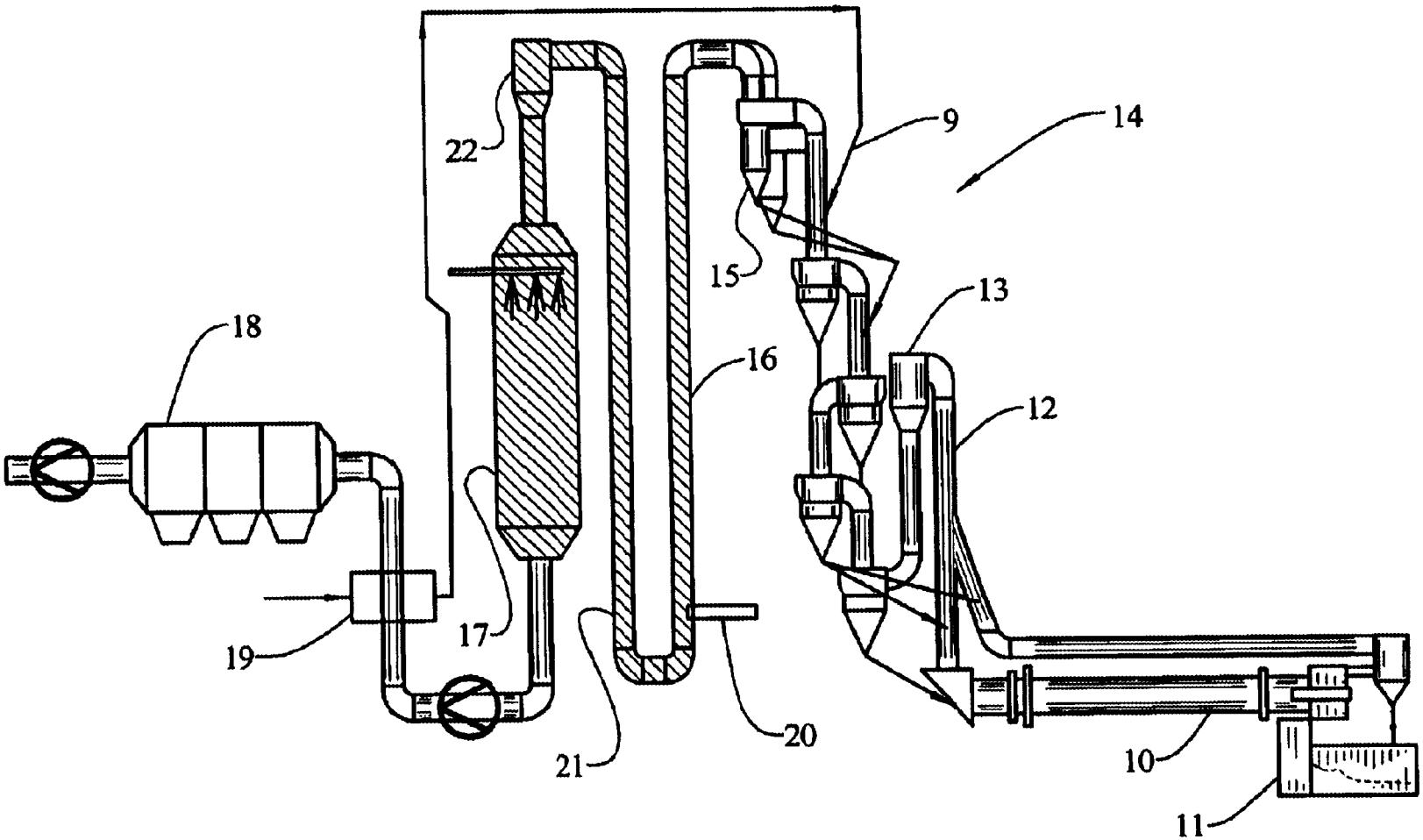
FIG. 1 is a flow diagram of an apparatus for the manufacture of cement clinker.

FIG. 1 schematically shows an apparatus for the manufacture of cement clinker from cement raw meal, which is fed from a crusher and drier plant 19 using waste gas and is directed via a line 9 from the top to a cyclone gas heat exchange line 14, so it flows in co-current/countercurrent with hot waste gas through a succession of cyclone stages, it is subsequently calcined in a pre-calcination stage 12, and, after being separated in the lowermost cyclone, it is directed to a rotary kiln 10 where it is fired into cement clinker, which is then cooled in a clinker cooler 11 after leaving the rotary kiln 10. In general, as illustrated in FIG. 1, the material flows from left to right.

This material flow moves opposite to a partial flow of a cooler exhaust air from the clinker cooler 11 and the waste gas formed by reaction gases of rotary kiln 10, which generally move from right to left in FIG. 1.

In order to preheat the cement raw meal, the contact between the material flow and the waste gas flow begins at the upper end of the heat exchange line 14. The cement raw meal, which is prepared in the crusher and drier plant 19 from the raw materials, is taken by the uppermost cyclone 15, and it moves then from the top down through further cyclone stages of the heat exchange line 14, whereby the raw meal is heated. In the pre-calcination stage 12, which is provided downstream and which is supplied with fuel, in which the raw meal is brought in direct contact with the heated waste gas of the rotary kiln 10 as well as with heated cooler exhaust air, the calcination fuel is burned to result in high-degree calcination of the raw meal, whereby the following clinker preparation can be performed in a relatively shorter rotary kiln 10 because of the calcination that has already taken place.

In order to assure the pre-calcination outside the rotary kiln 10, the pre-calcination stage 12 bums the prevailing fraction of the quantity of fuel that is required to cover the overall demand for heat supply for cement clinker preparation. A mixing or swirling chamber 13 can be provided in the pre-calcination stage 12, in the upper turn thereof, to assure thorough mixing of the fuel jets with air oxygen, thus assuring the residual burnout of the calcination fuel.

The waste gas leaving the heat exchange line 14 at a temperature ranging from 280° C. to 360° C., which is laden with fine dust after contact with the raw meal, is then separated from dust in a scrubber 17, and the gas then flows through the crusher and drier plant 19 before it is finally separated from dust in a dust filter 18, e.g., an electrostatic precipitator and is removed as cleaned waste gas.

In the illustrated embodiment, an oxidation zone (20, 21, 22) according to the invention is provided between the heat exchange line 14 and the scrubber 17, which comprises an afterburner 20, an afterburner duct 21 made as an extension of an waste gas duct 16, and a swirling chamber 22. The afterburner duct 21 has a length such that even with a high waste gas velocity of about 15 m/s, the residence time of the waste gas in the oxidation zone is about 1.5 seconds.

Figure 2:
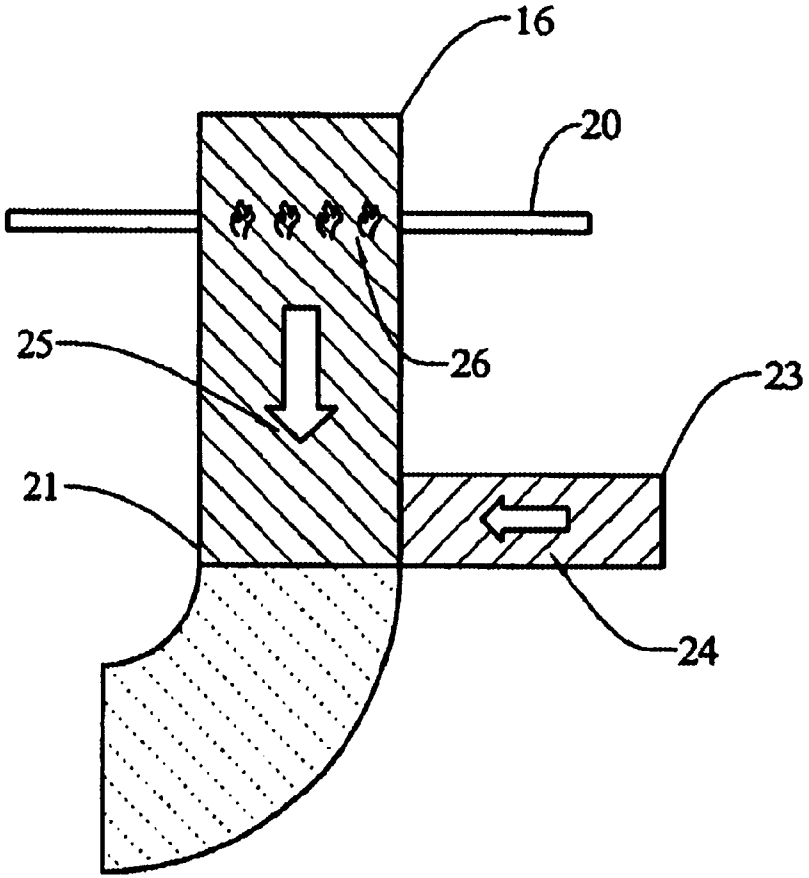
FIG. 2 is an enlarged partial view of an waste gas duct of FIG. 1, showing an afterburner.

FIG. 2 shows an enlarged partial view of FIG. 1 in the area of the afterburner 20. An waste gas flow 25 is admitted downwardly into the waste gas duct 16 through open flames 26 of the afterburner 20. The afterburner 20 is so constructed and adjusted that the open flames 26 fill up the entire cross-sectional area of the waste gas duct 16, whereby the entire waste gas flow 25 is positively brought in contact with the open flames 26.

A fresh air supply line 23 connects to the afterburner duct 21 in a spaced relation to the afterburner 20, and fresh air 24 is admitted through this line to mix with the waste gas 25 for cooling the waste gas 25 and/or for keeping constant the oxygen excess within the oxidation zone (20, 21, 22).

The illustrated embodiment of the invention, in which the afterburner is provided upstream of the scrubber, shows only one of many potential applications of the invention. It is, however, important that the waste gas 25 that leaves the heat exchange line 14 be completely oxidized in the afterburner constructed and positioned according to the invention in order to reduce the undesired pollutant emissions.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A method for thermal processing of powder raw materials in a manufacture of cement clinker from raw meal, in which raw materials are preheated as the raw materials move in a material flow direction in at least one heat exchange line comprising a cyclone heat exchange system through which waste gas of a rotary kiln flows in a gas flow direction, the raw materials are calcined in a pre-calcination stage, and fired in a sintering zone of a rotary kiln into cement clinker, which is cooled in a downstream cooler, the rotary kiln waste gas flow supplied with fuel in the pre-calcination stage being used for the pre-calcination of the raw meal, comprising the further steps of directing an entire waste gas flow from the heat exchange line through an oxidation zone downstream of the heat exchange line in the gas flow direction, the oxidation zone having an excess of oxygen and open flames provided by an afterburner, in order to assure burnout or oxidation of pollutant substances CO, $S^{2-}$, VOC (volatile organic carbon) such as hydrocarbons caused by a respectively high level of TOC (total organic carbon) and/or sulfides in the raw materials, which otherwise result in high emissions of pollutants.

2. The method of claim 1, including the step of feeding the waste gas flow of the heat exchanger line to waste gas conditioning through a scrubber.

3. The method of claim 2, wherein the burnout of pollutants of the waste gas is carried out in the oxidation zone, which is provided at least one of upstream and downstream of the scrubber in the gas flow direction.

4. The method of claim 1, including the step of directing the waste gas into an afterburner duct provided downstream of the afterburner where the waste gas remains with a residence time of about 1.5 seconds and is swirled in order to assure a complete burnout and complete oxidation of pollutants of the waste gas.

5. The method of claim 4, including the step of adding fresh air to the waste gas in the afterburner duct downstream of the afterburner in order to cool the waste gas and to constantly maintain the oxygen excess.

6. The method of claim 1, wherein an alternative fuel is burned in the afterburner.

7. The method of claim 6, wherein the alternative fuel is waste oil.

8. The method of claim 1, including the step of adjusting the afterburner in such a manner that a waste gas temperature is within the range from 450° C. to 680° C. when the waste gas leaves the oxidation zone.

9. The method of claim 1, including the step of lowering a temperature of the waste gas leaving the heat exchange line before the waste gas reaches the afterburner.

10. The method of claim 2, including the step of matching a cooling capacity of the scrubber to a temperature rise of the waste gas caused by the afterburner.

11. The method of claim 1, wherein a crusher and drier plant is installed downstream of the afterburner in the gas flow direction and including the step of controlling a waste gas temperature that is required for a crushing and drying by adjusting a temperature of the afterburner.

12. An apparatus for thermal processing of powder raw materials in a manufacture of cement clinker from raw meal, comprising at least one heat exchange line including a cyclone heat exchange system with a series of cyclone stages through which waste gas of a rotary kiln flows in a gas direction for preheating raw materials which flow in an opposite material direction, a pre-calcination stage for calcining the raw materials downstream of the cyclone heat exchange system in the material direction, a sintering zone of a rotary kiln where the calcined materials are fired into cement clinker downstream of the pre-calcination stage in the material direction, a cooler in which the cement clinker are cooled downstream of the sintering zone in the material direction, a supply of fuel in the rotary kiln waste gas flow through the pre-calcination stage to be used for the pre-calcination of the raw meal, and an oxidation zone downstream of the cyclone heat exchange system in the gas direction having an excess of oxygen and open flames provided by an afterburner through which the entire waste gas flow is directed.

13. The apparatus of claim 12, including at least one of a scrubber and a dust filter located downstream in the gas direction of the cyclone heat exchange system.

14. The apparatus of claim 13, wherein the oxidation zone is located upstream, in the gas direction, of the at least one of the scrubber and the dust filter.

15. The apparatus of claim 12, including a fresh air line that connects to a waste gas duct downstream of the afterburner in the gas direction.

16. The apparatus of claim 12, including an afterburner duct immediately downstream in the gas direction of the afterburner, a length of the afterburner duct corresponding to a residence time of the waste gas in the afterburner duct of about 1.5 seconds.

17. The apparatus of claim 16, including a mixing or swirling chamber provided in the afterburner duct.

18. The apparatus of claim 12, including a conventional heat exchange line as an extension of the cyclone stages.

* * * * *